US006475102B2

(12) United States Patent
Helmstetter et al.

(10) Patent No.: US 6,475,102 B2
(45) **Date of Patent: *Nov. 5, 2002**

(54) GOLF CLUB HEAD

(75) Inventors: Richard C. Helmstetter, Rancho Santa Fe, CA (US); Roger C. Cleveland, Los Angeles, CA (US); D. Clayton Evans, San Marcos, CA (US); J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/683,909

(22) Filed: Feb. 28, 2002

(65) Prior Publication Data

US 2002/0111229 A1 Aug. 15, 2002

Related U.S. Application Data

(63) Continuation of application No. 09/633,010, filed on Aug. 4, 2000, now Pat. No. 6,364,788.

(51) Int. Cl.[7] ..... A63B 53/04; A63B 53/06; A63B 53/08

(52) U.S. Cl. ..... 473/344; 473/324; 473/349; 473/338

(58) Field of Search ..... 473/338, 344, 473/345, 349, 350, 346, 342, 343, 300; 29/527.5, 527.3; 164/98

(56) References Cited

U.S. PATENT DOCUMENTS

| | | | |
|---|---|---|---|
| 4,180,269 | A | 12/1979 | Thompson |
| 4,313,607 | A | 2/1982 | Thompson |
| 4,319,752 | A | 3/1982 | Thompson |
| 4,429,879 | A | 2/1984 | Schmidt |
| 4,465,221 | A | 8/1984 | Schmidt |
| 4,489,945 | A | 12/1984 | Kobayashi |
| 4,756,534 | A | 7/1988 | Thompson |
| 4,824,116 | A | 4/1989 | Nagamoto et al. |
| 4,840,380 | A | 6/1989 | Kajita et al. |
| 4,874,171 | A | 10/1989 | Ezaki et al. |
| 4,890,840 | A | 1/1990 | Kobayashi |
| 5,013,041 | A | 5/1991 | Sun et al. |
| 5,028,049 | A | 7/1991 | McKeighen |
| 5,042,806 | A | 8/1991 | Helmstetter |
| 5,056,705 | A | 10/1991 | Wakita et al. |
| 5,078,400 | A | 1/1992 | Desboilles et al. |
| 5,141,230 | A | 8/1992 | Antonious |

(List continued on next page.)

*Primary Examiner*—Paul T. Sewell
*Assistant Examiner*—Sneh Varma
(74) *Attorney, Agent, or Firm*—Michael A. Catania

(57) ABSTRACT

A golf club head has a four-faceted sole. The golf club head has a body that has a volume between 140 cubic centimeters and 350 cubic centimeters. The body of the golf club head weighs between 140 grams and 215 grams. The golf club head preferably has a bismuth weighting system. The golf club head is preferably a driver, but may also be a fairway wood. The four-faceted sole is composed of a central facet, a toe facet, a heel facet and a rear facet.

10 Claims, 8 Drawing Sheets

U.S. PATENT DOCUMENTS 5,163,682 A 11/1992 Schmidt et al.
5,251,901 A 10/1993 Solheim et al.
5,294,037 A 3/1994 Schmidt
5,306,008 A 4/1994 Konoshita
5,310,186 A 5/1994 Karsten
5,421,577 A 6/1995 Kobayashi
5,447,309 A 9/1995 Vincent
5,499,819 A 3/1996 Nagamoto
5,720,674 A 2/1998 Galy
5,755,624 A * 5/1998 Helmstetter ..... 473/291
5,785,605 A 7/1998 Helmstetter
5,788,584 A 8/1998 Parente et al.
5,788,587 A * 8/1998 Tseng ..... 473/326
5,833,551 A 11/1998 Vincent et al.
5,851,160 A 12/1998 Rugge et al.
5,888,148 A * 3/1999 Allen ..... 473/290
5,908,356 A 6/1999 Nagamoto
6,126,556 A * 10/2000 Hsieh ..... 473/256
6,210,290 B1 * 4/2001 Erickson et al. ..... 473/345
6,325,728 B1 * 12/2001 Helmstetter et al. ..... 473/328
6,364,788 B1 * 4/2002 Helmstetter et al. ..... 473/324

* cited by examiner

GOLF CLUB HEAD

CROSS REFERENCE TO RELATED APPLICATIONS

The Present Application is a continuation application of U.S. patent application Ser. No. 09/633,010, filed on Aug. 4, 2000, now U.S. Pat. No. 6,364,788.

FEDERAL RESEARCH STATEMENT

[Not Applicable]

BACKGROUND OF INVENTION

1. Field of the Invention

The present invention relates to a golf club head. More specifically, the present invention relates to a large volume golf club head with a four-faceted sole.

2. Description of the Related Art

Golf club designs are constantly evolving with the primary purpose to improve a golfer's performance. While the improvements may address a number of areas, a designer strives to design a more forgiving golf club. Forgiveness in a golf club may be achieved by shifting the center-of-gravity of a golf club to a desirable location, and creating a larger moment of inertia.

It is difficult to increase forgiveness in a golf club head composed of a homogeneous or monolithic material, such as stainless steel, since there is a limit on the overall weight of a golf club acceptable to the typical golfer. To overcome this difficulty, designers have resorted to combining different materials (high density and low density) to achieve the desired center-of-gravity and large moment of inertia. A very high-density material provides a designer with the greatest freedom in improving the performance of a golf club head since less volume is needed to achieve the proper weighting. The most economical, commercially available material with a very high density is tungsten, which has a density of 19.3 grams per cubic centimeter.

One challenge in using heterogeneous materials is the ability to join the materials together in a golf club head Numerous techniques have been created by the golf industry to join heterogeneous materials in a golf club head One example is the GREAT BIG BERTHA® TUNGSTEN-TITANIUM™ irons, developed by the Callaway Golf Company of Carlsbad, Calif., which used a screw to attach a tungsten block to the rear and sole of a titanium iron. Another example is the GREAT BIG BERTHA® TUNGSTEN-INJECTED™ HAWK EYE® irons, also developed by the Callaway Golf Company, which feature an internal cavity with tungsten pellets in a solder, as set fort in U.S. Pat. No. 6,210,290, for an Internal Cavity Tungsten Titanium Iron, filed on Jun. 11, 1999. An example of a wood is the GREAT BIG BERTHA® HAWK EYE® drivers and fairway woods, also developed by the Callaway Golf Company, which use a tungsten screw in the sole of a titanium club head body. Other techniques use adhesives to join the materials, press fit the materials, braze the materials, or structurally hold one material piece within another material piece using undercuts or pockets.

For the most part, these techniques require a precisely machined weighting piece to fit within a precise location on a golf club head. The most economical method is to cast a golf club head body with a cavity for the weighting piece and attaching the weighting piece with a screw. However, casting tolerance are low, and require either machining of the cavity itself, or machining of the weighting piece to fit each cavity. The use of softer materials is undesirable since this creates difficulty in finishing the final product due to smearing of such soft materials during grinding of the golf club head.

Further, a co-casting process, where the weighting piece is incorporated in the mold prior to pouring the base metal, is very problematic depending on the materials since the weighting piece is relatively cold when the hot liquid base metal is cast around it causing thermal shock. Also, thermal expansion mismatch of materials is a problem with co-casting of heterogeneous materials. Other problems arise during re-shafting, where the golf club head is heated to remove the shaft. Such heating will result in low melting temperature materials (epoxies and solder) to flow, resulting in the possible movement of weighting pieces. Additionally, the secure and specific weighting mechanism of the prior art prevents the club from being weighted according to a particular swing of a particular golfer.

SUMMARY OF INVENTION

One aspect of the present invention is a sole for a golf club head having a crown, a toe end, a heel end and a striking plate. The sole includes a central facet, a heel facet, a toe facet and a rear facet. The central facet extends rearward from the striking plate, and has a first sole area. The heel facet is disposed adjacent to the central facet and has a second sole area. The toe facet is disposed adjacent to the central facet and has a third sole area. The rear facet is disposed rearward of the central facet and has a fourth sole area. The first sole area is larger than the combined areas of the second sole area, the third sole area and the fourth sole area.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
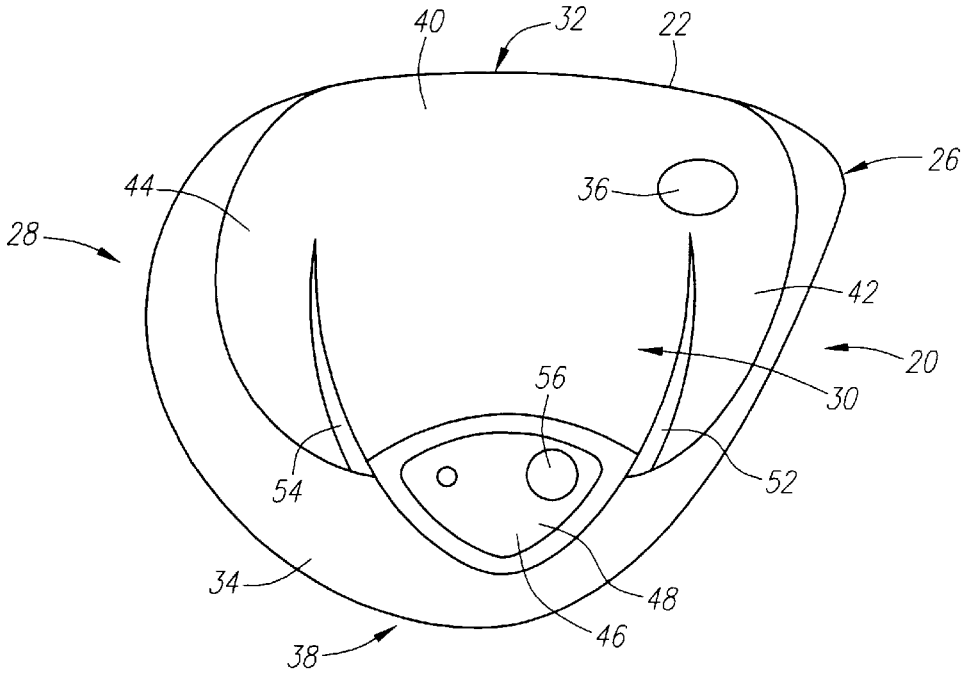
FIG. 1 is a bottom plan view of the sole of the golf club head of the present invention.
Figure 2:
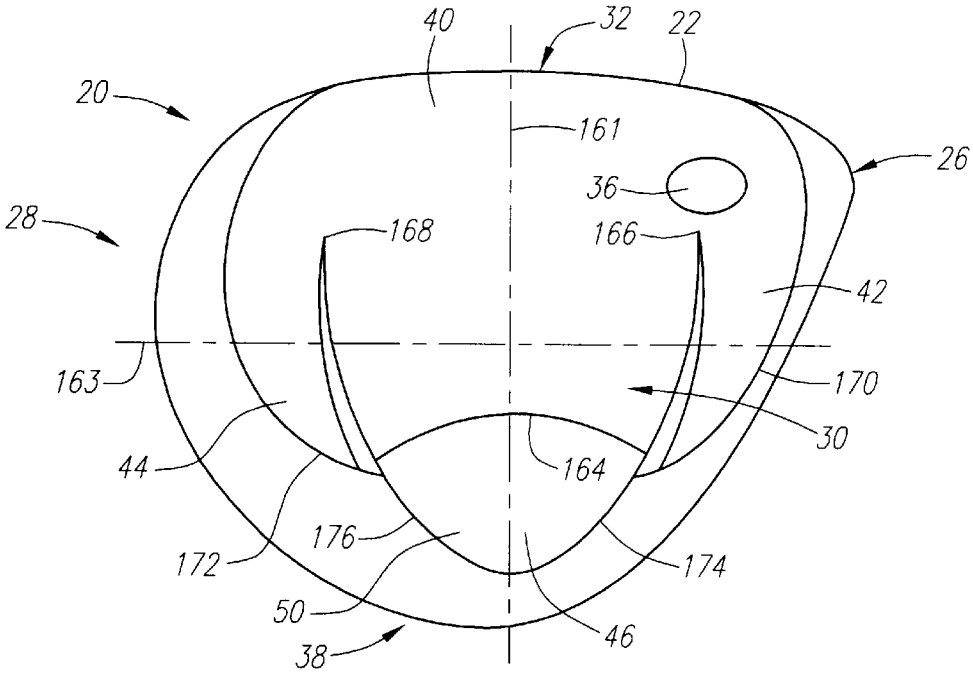
FIG. 2 is a bottom plan view of the sole of the golf club head of the present invention with a medallion positioned within a rear facet recess.
Figure 3:
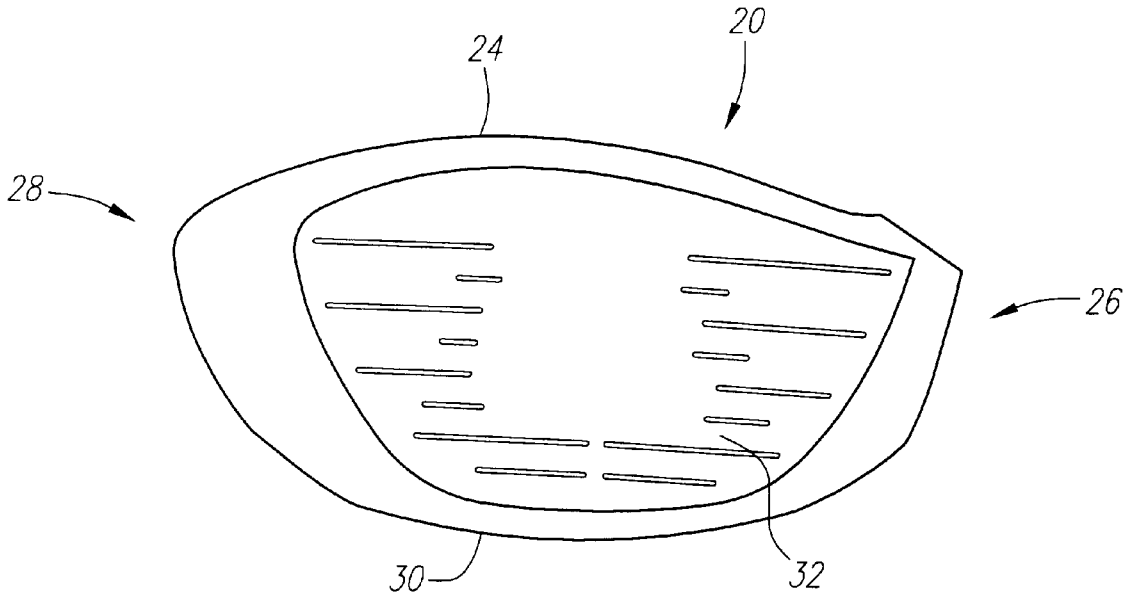
FIG. 3 is a front view of the golf club head of the present invention.
Figure 4:
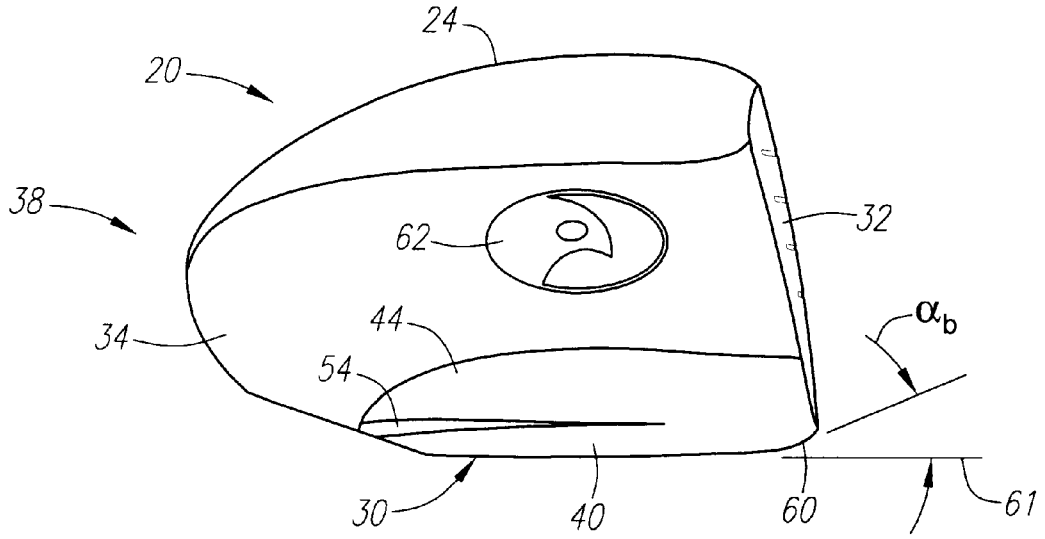
FIG. 4 is a side view of the toe end of the golf club head of the present invention.

As shown in FIGS. 1–8, the golf club head of the present invention is generally designated 20. The golf club head 20 is a driver, however, the golf club head of the present invention may alternatively be a fairway wood. The golf club head has a body 22 that is preferably composed of a metal material such as titanium, titanium alloy, stainless steel, or the like, and is most preferably composed of a forged titanium material. However, the body 22, or a portion of the body 22, may be composed of a graphite composite material or the like. The body 22, when designed as a driver, preferably has a large volume, typically greater than 300 cubic centimeters, and is most preferably 350 cubic centimeters for a body composed of titanium. However, when designed as a driver, a body 22 composed of stainless steel may have a volume range of 200 cubic centimeters to 275 cubic centimeters, and a body 22 composed of a composite material may have a volume of 325 cubic centimeters to 400 cubic centimeters. The body 22, when designed as a driver, preferably weighs no more than 215 grams, and most preferably weighs between 180 and 205 grams. When the body 22 is designed as a fairway wood, the body weighs from 135 grams to 180 grams, and preferably from 140 grams to 165 grams. The body 22 has a hollow interior 23.

The body 22 has a crown 24, a heel end 26, a toe end 28, a sole 30, a striking plate 32 and a ribbon 34. A shaft, not shown, is placed within a hosel, not shown, at the heel end 26. In a preferred embodiment, the hosel is internal to the body 22, and the shaft extends to the sole 30 at a bore 36. The body 22 also has a rear section 38 that is opposite the striking plate 32.

The sole 30 of the present invention is designed to function in a high performance, large volume driver or fairway wood. Such a high performance, large volume driver or fairway wood is designed for compliance during impact with a golf ball in order to reduce the energy loss for greater distance. Such a driver or fairway wood is disclosed in U.S. Pat. No. 6,354,962, filed on Nov. 1, 1999 for a Golf Club Head With A Forged Titanium Striking Plate, which is hereby incorporated by reference in its entirety. The sole 30 of the present invention is able to function in a high performance, large volume driver due to its unique four facet structure.

The sole 30 of the present invention has a central facet 40, a heel facet 42, a toe facet 44 and a rear facet 46. The rear facet 46 preferably defines a recess 48 that is covered by a medallion 50. Due to the angle to the central facet 40, the heel facet 42 and the toe facet 44 have a transition edge 52 and 54 respectively. The rear facet 46 is also angled to the central facet 40, and is used for access to the hollow interior 23 of the body 22 through a portal 56.

The central facet 40 has a bounce edge 160 nearest the striking plate 32. The bounce edge 160 prevents or substantially reduces ground interference during a golf swing. The bounce edge 160 is preferably at an angle of between 10 to 30 degrees relative to a central longitudinal line 161, and is most preferably at an angle of 25 degrees relative to a central longitudinal line 161.

The central facet 40 is defined by the bounce edge 160, an arcuate edge 64 adjacent the rear facet 46, a heel curved edge 166 adjacent the heel facet 42, and a toe curved edge 168 adjacent the toe facet 44. The central facet 40 preferably has a first sole area that ranges from 4.0 to 6.0 square inches, and more preferably ranges 4.75 square inches to 5.25 square inches, and is most preferably 5.1 square inches. The central facet 40 preferably occupies between 50 to 70 percent of the total sole surface area, more preferably 55 to 65 percent of the total surface area, and most preferably 57 percent of the total sole surface area.

The heel facet 40 is defined by a portion of the bounce edge 160, the heel curved edge 166 adjacent the central facet 40, and a heel-ribbon edge 170 adjacent a portion of the ribbon 34. The heel facet 42 preferably has a second sole area that ranges from 1.0 to 2.0 square inches, and more preferably ranges 1.25 square inches to 1.75 square inches, and is most preferably 1.5 square inches. The heel facet 42 preferably occupies between 10 to 25 percent of the total sole surface area, more preferably 15 to 20 percent of the total surface area, and most preferably 17 percent of the total sole surface area.

The toe facet 44 is defined by a portion of the bounce edge 160, the toe curved edge 168 adjacent the central facet 40, and a toe-ribbon edge 172 adjacent a portion of the ribbon 34. The toe facet 44 preferably has a third sole area that ranges from 0.75 to 2.0 square inches, and more preferably ranges 1.0 square inches to 1.5 square inches, and is most preferably 1.13 square inches. The toe facet 44 preferably occupies between 5 to 25 percent of the total sole surface area, more preferably 10 to 15 percent of the total surface area, and most preferably 13 percent of the total sole surface area.

The rear facet 46 is defined by the central arcuate edge 164 adjacent the central facet 40, a heel arcuate edge 174 adjacent a portion of the heel facet 42 and a portion of the ribbon 34, and a toe arcuate edge 176 adjacent a portion of the toe facet 44 and a portion of the ribbon 34. Preferably, the rear facet 46 has a rounded triangular shape. The rear facet 46 preferably has a fourth sole area that ranges from 1.0 to 2.0 square inches, and more preferably ranges 1.15 square inches to 1.5 square inches, and is most preferably 1.23 square inches. The rear facet 46 preferably occupies between 5 to 25 percent of the total sole surface area, more preferably 10 to 20 percent of the total surface area, and most preferably 14 percent of the total sole surface area. The total sole surface area preferably ranges from 7.0 square inches to 11 square inches, more preferably from 8.0 square inches to 9.5 square inches, and most preferably is 8.95 square inches.

The sole 30 of the present invention allows for the center of gravity to be lowered for better distance and a lower spin on a golf ball after impact with the golf club head 20. The four faceted design optimizes the performance of a high performance, large volume driver or fairway wood. The central facet 40 preferably is slightly downwardly convex from the central longitudinal line 161 toward each of the heel end 26 and toe end 28. The heel facet 42 and the toe facet 44 are each preferably angled between 10 to 30 degrees relative to the central latitudinal line 163 and more preferably 20 to 25 degrees relative to the central latitudinal line 163. The rear facet 44 is angled between 10 to 30 degrees relative to the central longitudinal line 161 and more preferably between 20 to 25 degrees relative to the central longitudinal line 161.

Figure 8:
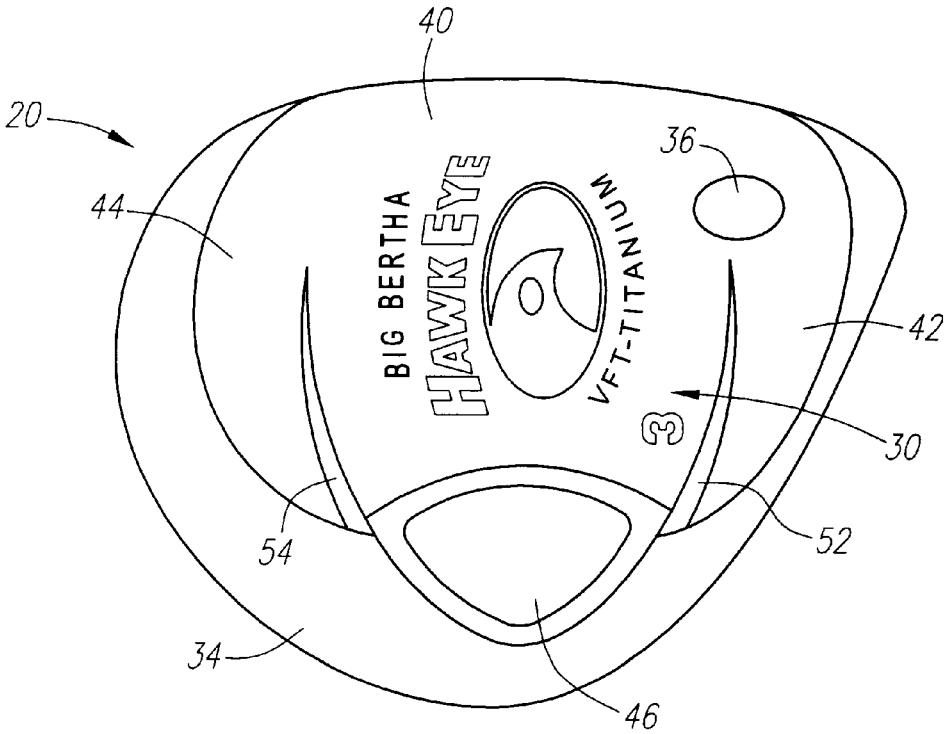
FIG. 8 is a bottom plan view of the sole of the golf club head of the present invention with indicia on the sole.
Figure 9:
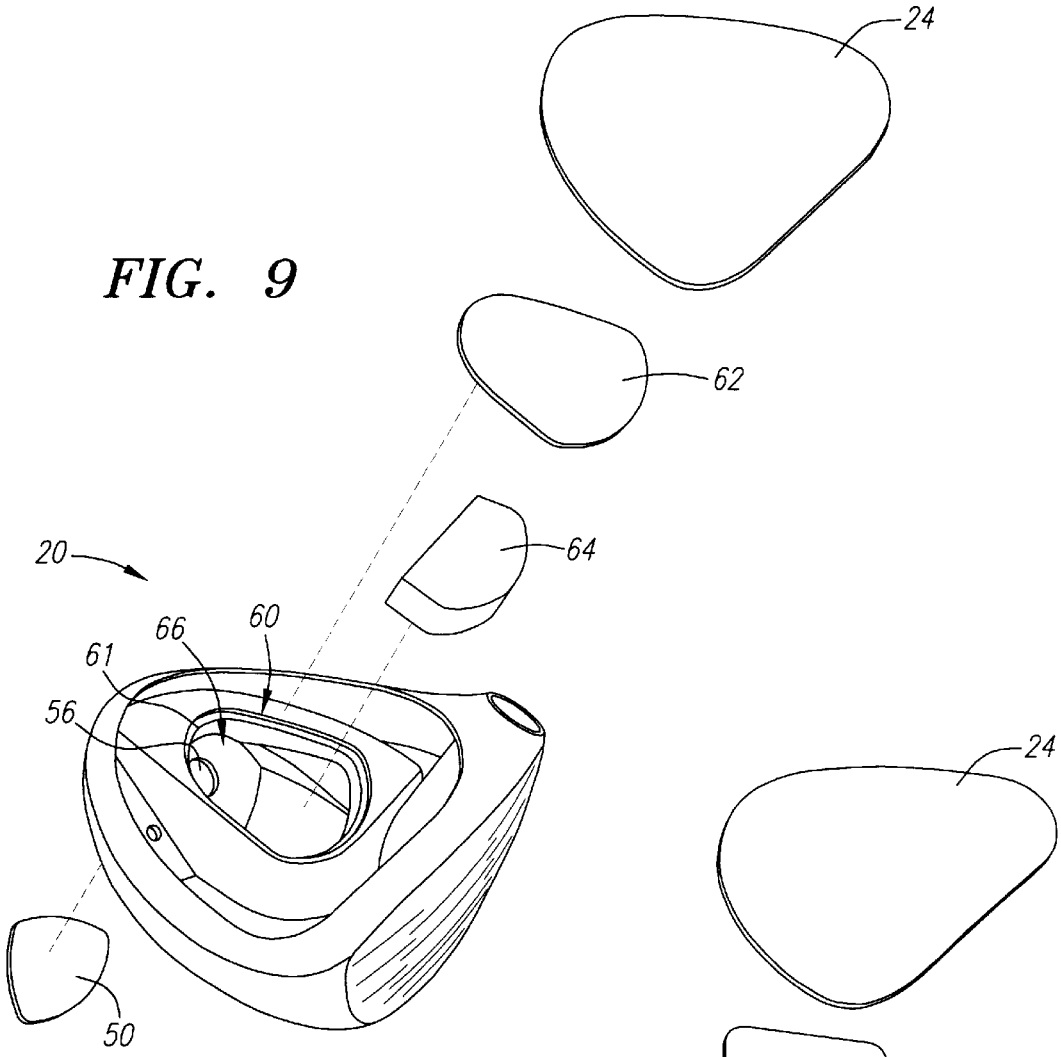
FIG. 9 is an exploded top view of the components of the preferred embodiment of the golf club head of the present invention.
Figure 10:
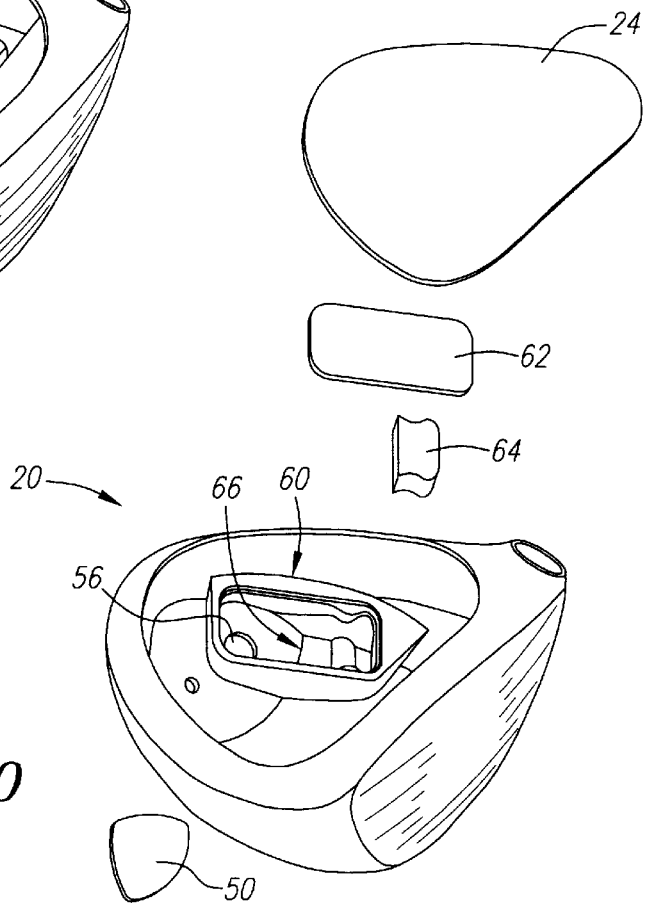
FIG. 10 is an exploded top view of the components of an alternative embodiment of the golf club head of the present invention.
Figure 11:
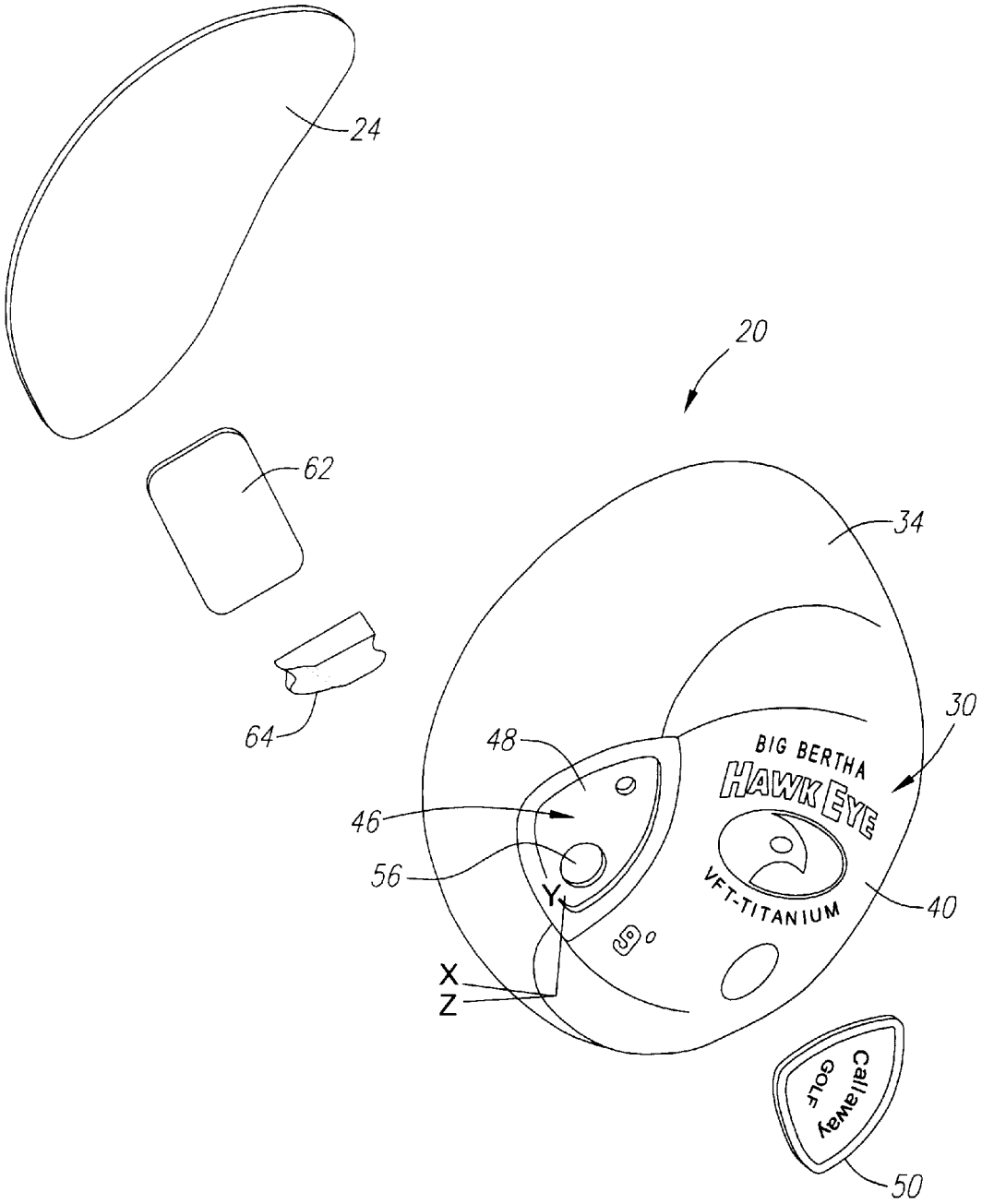
FIG. 11 is an exploded bottom view of FIG. 10.
Figure 12:
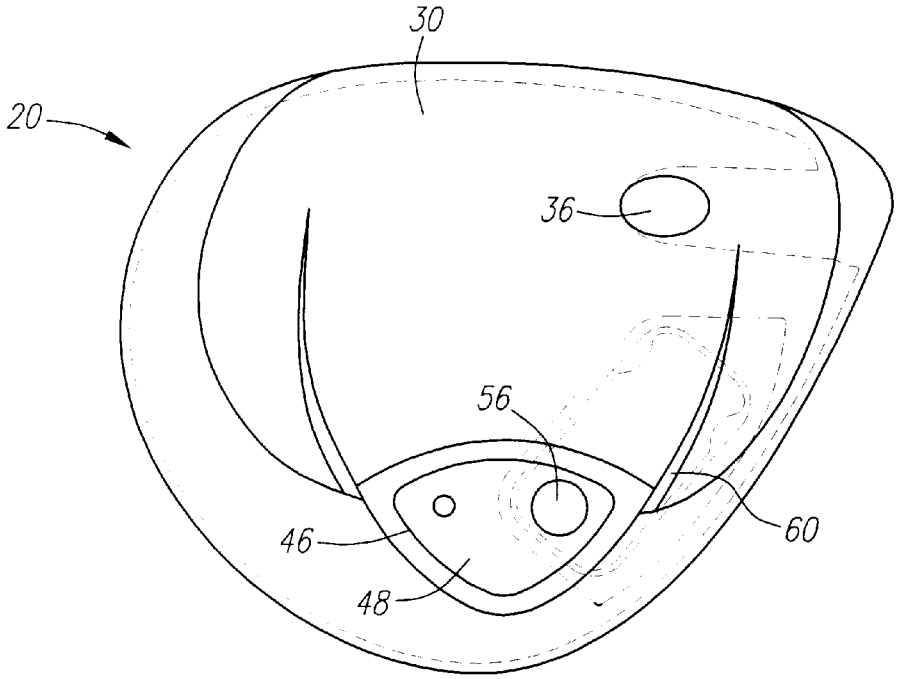
FIG. 12 is a bottom view of the golf club head of FIG. 10 showing the weight compartment in phantom lines.
Figure 13:
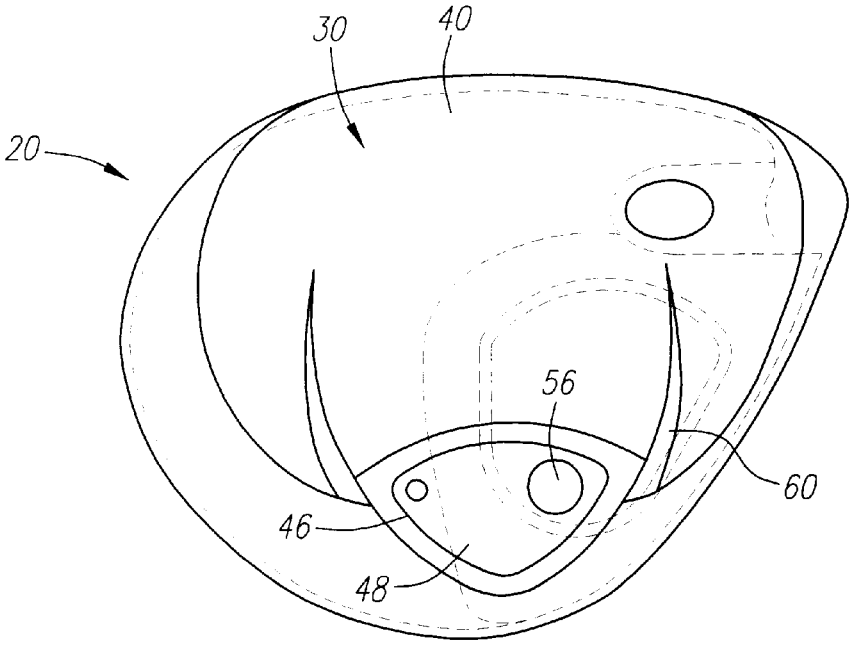
FIG. 13 is a bottom view of the golf club head of FIG. 9 showing the weight compartment in phantom lines.
Figure 14:
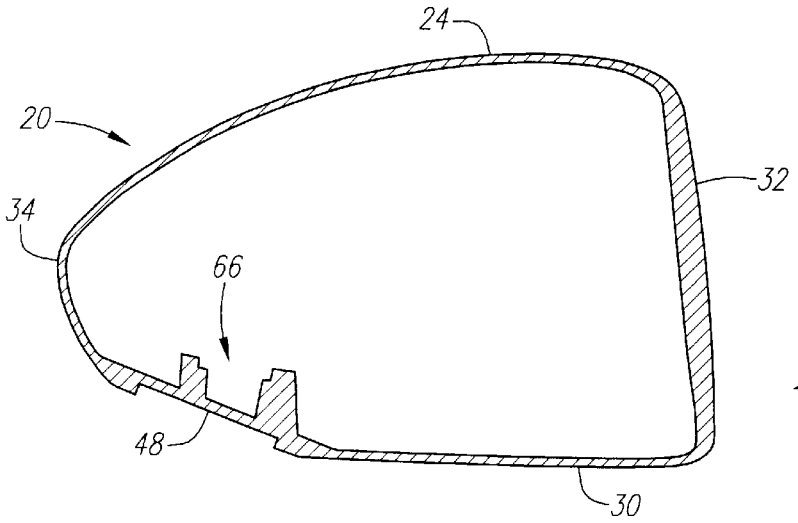
FIG. 14 is a cross-sectional view of the golf club head of FIG. 10.
Figure 15:
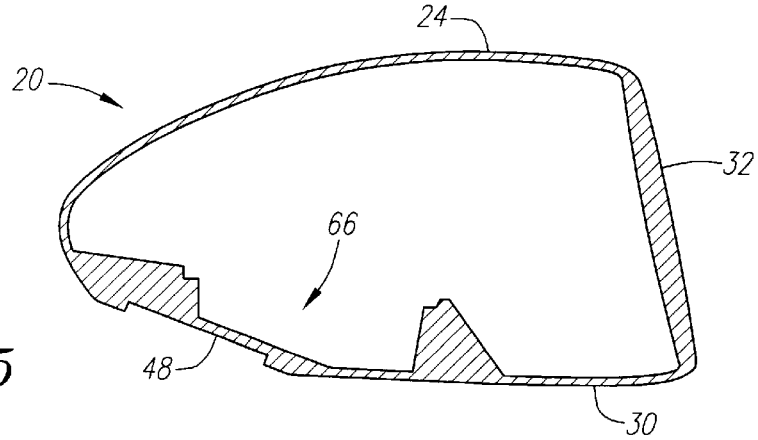
FIG. 15 is a cross-sectional view of the golf club head of FIG. 9.

As shown in FIG. 8, the central facet 40 of the sole 30 of the present invention provides a wide canvas for engraving of indicia thereon for marketing purposes. The medallion 50 of the rear facet 46 also provides a canvas or surface for marketing purposes.

Table One provides information concerning the preferable mass, center of gravity and moment of inertia for a golf club head of the present invention. Those skilled in the pertinent art will recognize that the mass, center of gravity or moment of inertia may be modified without departing from the scope and spirit of the present invention. For example, the moment of inertia may exceed 3000 g/cm$^2$ in one or more directions.

| | Head | Center of Gravity, in | | | Moments of Inertia, g/cm$^2$ | | |
|---|---|---|---|---|---|---|---|
| Clubhead | Mass | X | Y | Z | Ixx | Iyy | Izz |
| 07° Driver | 188.51 g | 0.683 | 0.622 | 0.948 | 2170 | 1787 | 2768 |
| 08° Driver | 188.86 g | 0.679 | 0.622 | 0.946 | 2172 | 1794 | 2780 |
| 09° Driver | 189.50 g | 0.673 | 0.624 | 0.946 | 2185 | 1815 | 2804 |
| 10° Driver | 189.13 g | 0.672 | 0.627 | 0.944 | 2194 | 1827 | 2818 |
| 11° Driver | 189.24 g | 0.662 | 0.631 | 0.944 | 2152 | 1781 | 2835 |
| 12° Driver | 189.70 g | 0.657 | 0.630 | 0.943 | 2156 | 1793 | 2850 |
| Ave. | 189.16 g | 0.671 | 0.626 | 0.945 | 2172 | 1800 | 2809 |
| Range | 1.19 g | 0.026 | 0.009 | 0.005 | 42 | 46 | 82 |

FIGS. 9–15 illustrate the weight system of the golf club head 20 of the present invention. A body 61 and a weight chamber 66 define the weight compartment 60. A top lid 62 allows for access to the weight chamber 66, however, the top lid 62 is sealed prior to weighting of the golf club head 20. A weight member 64 is injected into the weight chamber 66 via the portal 56, as further described below. The portal 56 allows for access to the weight compartment 60 after the crown 24 has been welded to the entirety of the body 22. After injection of the weight member 64, the portal is sealed by placement of the medallion 50 into the recess 48.

The post-golf club head formation weighting allows for weight to be added to the golf club head 20 for adjustments and/or customization for a particular golfer. Further, this allows for weight to be added to the golf club head 20 after the weight of the body 22 has been determined in order to meet predetermined specifications for the golf club head 20. Preferably, the weight compartment 60 is cast with the body 22 if the club head is composed of cast titanium or cast steel. Alternatively, the weight compartment 60 may be welded to the interior surface of the sole 30 if it is formed separate from the body 22.

The volume of the weight chamber 66 may vary from 4 cubic centimeters (cc) to 14 cc depending on the club. The preferred volumes of the weight chambers 66 for fairway woods is set forth in Table Two. The weight chambers 66 for drivers will have volumes that vary from the fairway woods. The weight member 64 preferably occupies between 30% to 95% of the volume of the weight chamber 66, and most preferably from 50% to 80% of the volume of the weight chamber 66.

| Club | Weighting material Min. Volume | Weighting Material Max. Volume | Weight Chamber Volume |
|---|---|---|---|
| 2 | 2.116 | 6.001 | 7.045 |
| 3 | 2.102 | 5.332 | 6.484 |
| Strong 3 | 3.103 | 7.984 | 9.354 |
| 4 | 3.215 | 8.390 | 9.329 |
| Strong 4 | 3.630 | 9.619 | 10.943 |
| 5 | 3.826 | 9.504 | 10.481 |
| 7 | 3.854 | 9.639 | 11.119 |
| 9 | 3.854 | 9.639 | 11.119 |

TABLE THREE

| Drivers | Body Weight | With Bismuth Weighting |
|---|---|---|
| 2 Wood | 165.2 | 195.3 |
| Strong 3 Wood | 157.4 | 199.3 |
| 3 Wood | 156.9 | 199.3 |
| Strong 4 Wood | 150.3 | 202.3 |
| 4 Wood | 151.3 | 202.3 |
| 5 Wood | 147.3 | 206.3 |
| 7 Wood | 142.5 | 210.3 |
| 9 Wood | 149.6 | 215.3 |

Figure 5:
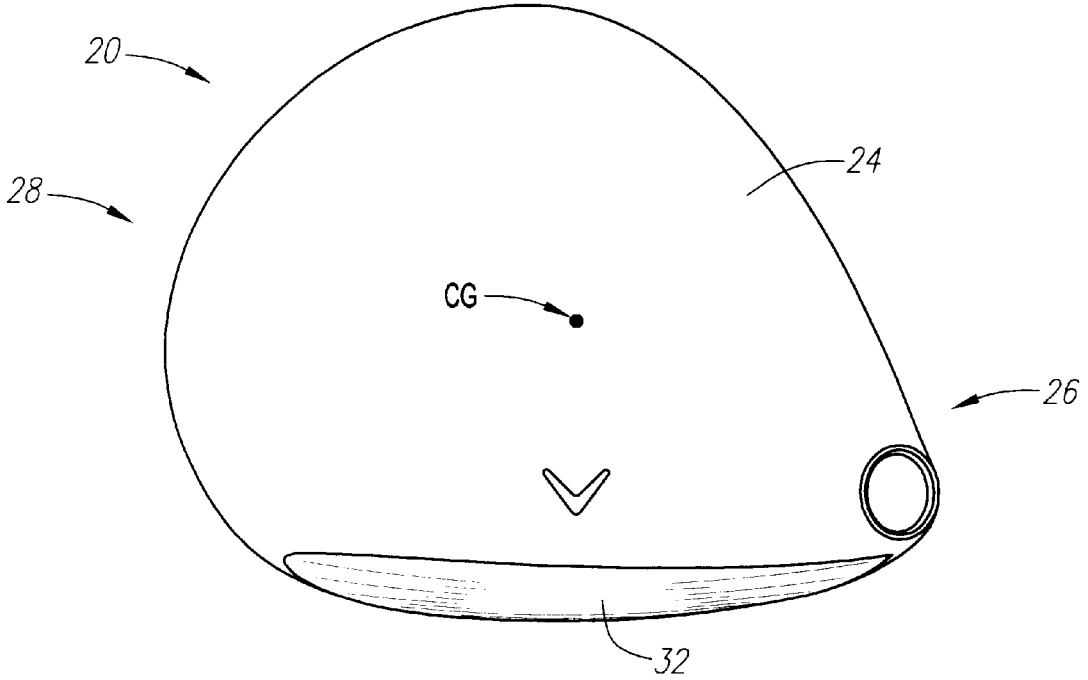
FIG. 5 is a top plan view of the golf club head of the present invention.
Figure 6:
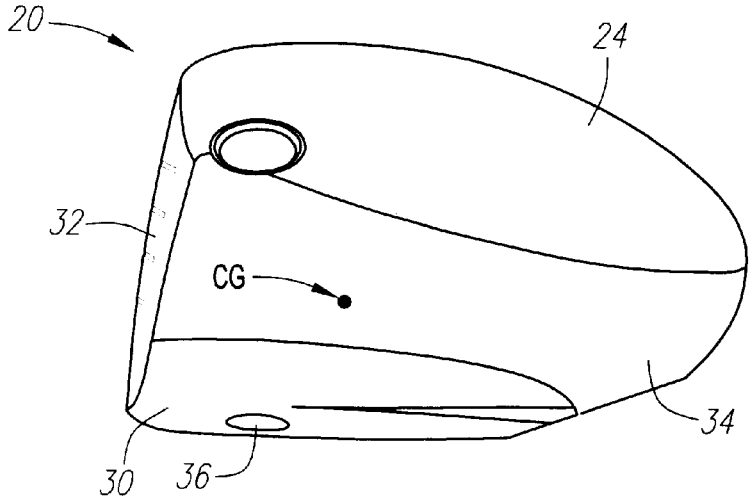
FIG. 6 is side view of the heel end of the golf club head of the present invention.
Figure 7:
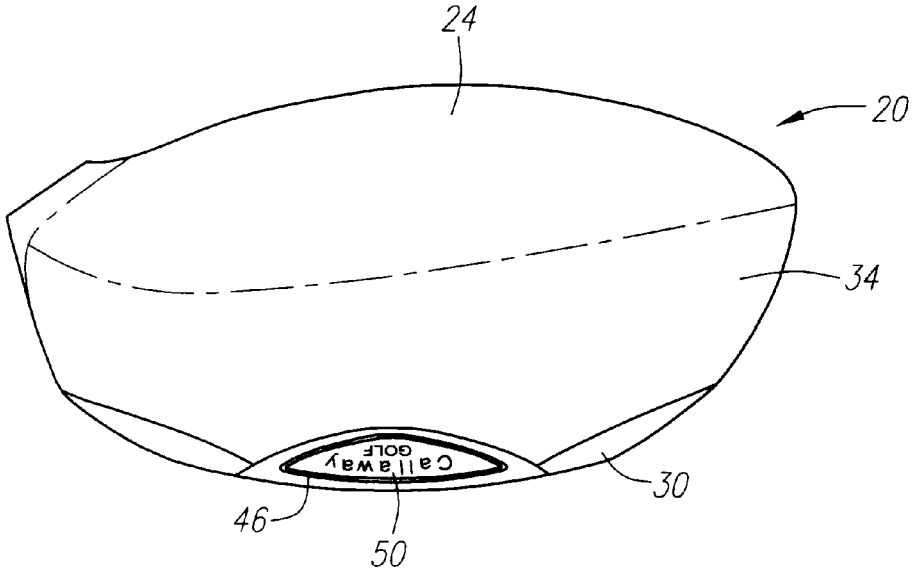
FIG. 7 is a rear view of the golf club head of the present invention.

The weight compartment 60 is positioned within the hollow interior 23 of the body 22 to adjust the center of gravity of the golf club head 20 off-center toward the heel end 26. The center of gravity will vary for drivers of depending on the loft, and for fairway woods depending on the fairway wood. The center of gravity, CG, for the driver golf club head of FIGS. 1–8, is shown in FIGS. 5 and 6. The ability of the liquid bismuth to flow and conform to a particular weight chamber allows for greater control of the center of gravity of the golf club head, and also allows for better control of the moment of inertia of the golf club head.

The bismuth weight member 64 is introduced through the portal 56 while the striking plate 32 is oriented downward and lying flat on a surface. Thus, the bismuth weight member 64 will first occupy the space of the weight chamber 66 that is towards the striking plate 32 and continue to fill the weight chamber 66 toward the rear of the body 22. In a preferred method, 90% of the predetermined amount of liquid bismuth weight chamber 64 is introduced, and then the golf club head 20 is weighed to determine if any additional bismuth is needed to meet the specifications of the particular golf club. Additional bismuth is added to the weight chamber 66 if necessary to meet the specification requirements. Those skilled in the pertinent art will recognize that other materials may be used as the weight member 64 without departing from the scope and spirit of the present invention.

Figure 16:
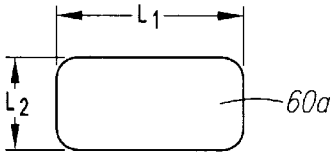
FIG. 16 is an isolated top plan view of a weight compartment of the present invention.
Figure 17:
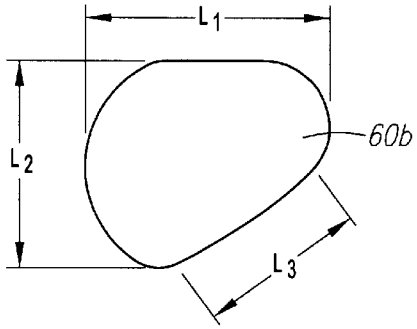
FIG. 17 is an isolated top plan view of a weight compartment of the present invention.
Figure 18:
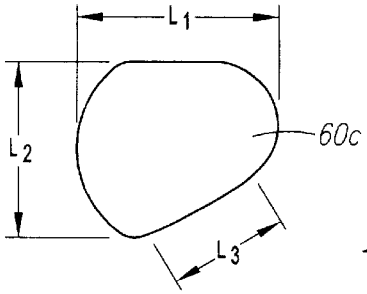
FIG. 18 is an isolated top plan view of a weight compartment of the present invention.

Isolated views of various weight compartments 60*a–c* are shown in FIGS. 16–18.

The depths of the weight compartments 60*a–c* preferably vary from 0.5 inch to 2.0 inches. The area of the particular weight compartment 60 varies depending on the club. In FIG. 16, the length, $L_1$, of the weight compartment 60*a* is preferably 1.474 inches and the length, $L_2$, is 0.754 inch. In FIG. 17, the length, $L_1$, of the weight compartment 60*b* is preferably 1.836 inches, the length, $L_2$, is 1.609 inches, and the length, $L_3$, is 1.269 inches. In FIG. 18, the length, $L_1$, of the weight compartment 60*c* is preferably 1.511 inches, the length, $L_2$, is 1.395 inches, and the length, $L_3$, is 0.934 inches. The shape and the location of the weight compartment 60 will affect the center of gravity of the golf club head 20 and the moment of inertia.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A sole for a golf club head having a crown, a toe end, a heel end and a striking plate, the sole comprising: a central facet extending rearward from the striking plate, the central facet having a first sole area; a heel facet disposed adjacent to the central facet and having a second sole area; a toe facet disposed adjacent to the central facet and having a third sole area; and a rear facet disposed rearward of the central facet and having a fourth sole area; whereby the first sole area is larger than the combined areas of the second sole area, the third sole area and the fourth sole area.

2. A golf club head comprising: a body having a volume greater than 300 cubic centimeters, having a hollow interior, and having a crown, a striking plate, a ribbon, a heel end, a toe end and a sole, the sole comprising a central facet extending rearward from the striking plate, the central facet having a first sole area having an area ranging from 4.0 to 6.0 square inches, a heel facet disposed adjacent to the central facet, angled toward the ribbon relative to the central facet, and having a second sole area having an area ranging from 1.0 to 2.0 square inches, a toe facet disposed adjacent to the central facet, angled toward the ribbon relative to the central facet, and having a third sole area having an area ranging from 1.0 to 2.0 square inches, anda rear facet disposed rearward of the central facet, angled toward the ribbon relative to the central facet, and having a fourth sole area having an area ranging from 0.5 to 2.0 square inches.

3. The golf club head according to claim 2 wherein the golf club head is composed of a material selected from the group consisting of titanium, titanium alloy and steel.

4. A golf club head comprising: a body having a crown, a striking plate, a heel end, a toe end and a sole, the sole comprising a central facet extending rearward from the striking plate, the central facet having a first sole area occupying 50 to 70 percent of the total sole surface area, a heel facet disposed adjacent to the central facet and having a second sole area occupying 10 to 25 percent of the total sole surface area, a toe facet disposed adjacent to the central facet and having a third sole area occupying 5 to 25 percent of the total sole surface area, and a rear facet disposed rearward of the central facet and having a fourth sole area occupying 10 to 25 percent of the total sole surface area.

5. A golf club head comprising: a body having a crown, a sole, a striking plate, a heel end an toe end and a hollow interior; a weight compartment disposed within the hollow interior and connected to the sole, the weight compartment defining a chamber of a predetermined volume; a weight member disposed within the weight compartment, the weight member weighing between 3 grams and 70 grams, and composed of a material having a density between 7 grams/cubic centimeter and 20 grams/cubic centimeter.

6. The golf club head according to claim 5 wherein the weight member is composed of bismuth.

7. The golf club head according to claim 5 wherein the body has a volume of 140 cubic centimeters to 350 cubic centimeters.

8. The golf club head according to claim 5 wherein the body weighs between 135 grams to 205 grams.

9. The golf club head according to claim 5 wherein the sole has four facets.

10. The golf club head according to claim 9 wherein one of the facets is a rear facet having a recess for placement of a medallion therein, and also having a portal for access to the weighting compartment.

* * * * *